US011434721B2

(12) United States Patent
Joubran et al.

(10) Patent No.: US 11,434,721 B2
(45) Date of Patent: Sep. 6, 2022

(54) PACKAGING OF A DIODE AND SIDAC INTO AN ACTUATOR OR MOTOR FOR DOWNHOLE USAGE

(71) Applicant: Halliburton Energy Services, Inc., Houston, TX (US)

(72) Inventors: Jonathon Najib Joubran, Houston, TX (US); Lorenzzo Breda Minassa, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 157 days.

(21) Appl. No.: 16/963,108

(22) PCT Filed: Sep. 5, 2019

(86) PCT No.: PCT/US2019/049815
§ 371 (c)(1),
(2) Date: Jul. 17, 2020

(87) PCT Pub. No.: WO2021/045768
PCT Pub. Date: Mar. 11, 2021

(65) Prior Publication Data

US 2021/0404289 A1 Dec. 30, 2021

(51) Int. Cl.
*E21B 34/06* (2006.01)
*E21B 23/00* (2006.01)

(52) U.S. Cl.
CPC ..... *E21B 34/066* (2013.01); *E21B 23/00* (2013.01)

(58) Field of Classification Search
CPC ..... E21B 34/066; E21B 34/06; E21B 34/10; E21B 34/14; E21B 34/142; E21B 34/16; E21B 23/00; E21B 23/04; E21B 23/0411–0419; E21B 23/042–0423; E21B 43/12; E21B 43/14; H01F 7/06;
(Continued)

(56) References Cited

U.S. PATENT DOCUMENTS 3,215,902 A * 11/1965 Foley ..... H01F 7/1607 335/255
3,509,910 A * 5/1970 Nelson ..... E21B 43/14 137/236.1

(Continued)

OTHER PUBLICATIONS

ISRWO International Search Report and Written Opinion for PCT/US2019/049815 dated Jun. 3, 2020.

*Primary Examiner* — George S Gray
(74) *Attorney, Agent, or Firm* — Scott Richardson; C. Tumey Law Group PLLC

(57) ABSTRACT

An actuation module may comprise a housing, a solenoid operated valve solenoid operated valve disposed in the housing, a diode disposed in the housing, a silicon bilateral voltage triggered switch thyristor disposed in the housing and electrically connected to the solenoid operated valve, and an output connected to the solenoid operated valve. A method may comprise connecting an actuation module to a production tubing valve, connecting the actuation module to a valve control system, connecting an information handling system to the valve control system, controlling the actuation module with the valve control system, and activating the production tubing valve with the actuation module.

18 Claims, 4 Drawing Sheets

(58) Field of Classification Search
CPC ..... H01F 7/16; H02J 1/00; H02J 1/001; H02J 13/0003; H03K 17/292
See application file for complete search history.

(56) References Cited

U.S. PATENT DOCUMENTS

| | | | | |
|---|---|---|---|---|
| 5,358,035 | A * | 10/1994 | Grudzinski | E21B 34/066 340/856.4 |
| 6,138,754 | A | 10/2000 | Veneruso et al. | |
| 6,253,843 | B1 * | 7/2001 | Rawson | E21B 34/066 166/332.8 |
| 8,476,786 | B2 | 7/2013 | Shaw | |
| 8,590,609 | B2 | 11/2013 | Smithson et al. | |
| 9,938,823 | B2 | 4/2018 | Deville et al. | |
| 2010/0237698 | A1 | 9/2010 | Smithson | |
| 2011/0210609 | A1 * | 9/2011 | Smithson | E21B 23/00 307/38 |
| 2011/0309678 | A1 * | 12/2011 | Shaw | H02J 1/14 307/31 |
| 2012/0067593 | A1 * | 3/2012 | Powell | E21B 34/066 166/373 |
| 2017/0092406 | A1 | 3/2017 | Chu | |
| 2018/0016865 | A1 * | 1/2018 | El Mallawany | H03K 17/292 |
| 2018/0051534 | A1 * | 2/2018 | El Mallawany | E21B 47/12 |
| 2018/0119522 | A1 * | 5/2018 | Prost | E21B 34/066 |
| 2019/0017368 | A1 | 1/2019 | El Mallawany | |

* cited by examiner

PACKAGING OF A DIODE AND SIDAC INTO AN ACTUATOR OR MOTOR FOR DOWNHOLE USAGE

BACKGROUND

Oil and gas wells formed in the earth often traverse several formation layers or regions of the earth, which may include one or more hydrocarbon reservoirs. Production operations may work to remove hydrocarbons from the hydrocarbon reservoirs. During production operations it may be useful to selectively actuate well tools in a subterranean well. For example, production flow from each of multiple zones of a reservoir may be individually regulated by using a remotely controllable valves for each respective zone. The valves be interconnected in a production tubing string so that, by varying the setting of each valve, the proportion of production flow entering the tubing string from each valve can be maintained or adjusted as desired.

Currently, this concept is a complex practice. In order to be able to individually actuate multiple downhole well tools, a relatively large number of wires, lines, etc. must be installed and/or complex wireless telemetry and downhole power systems need to be utilized. Each of these scenarios involves may use of potentially unreliable downhole electronics and/or the extending and sealing of many lines through bulkheads, packers, hangers, wellheads, etc.

BRIEF DESCRIPTION OF THE DRAWINGS

For a detailed description of the examples of the disclosure, reference will now be made to the accompanying drawings in which.

DETAILED DESCRIPTION

The present disclosure provides systems and methods for forming an actuation module. An actuation module may be used in production operations to reduce wire, lines, and/or other downhole systems to operate downhole devices with more reliability. In examples, an actuation module may combine a solenoid operated valve, linear actuator, linear solenoid or an electric motor with a diode and a silicon bilateral voltage triggered switch thyristor as a single packaged and sealed unit. The actuation module may combine passive electronics into a single package for simplified installation, which may eliminate parts from downhole systems. Additionally, the actuation module may be used on any downhole device, such as valves and completion tools.

Figure 1:
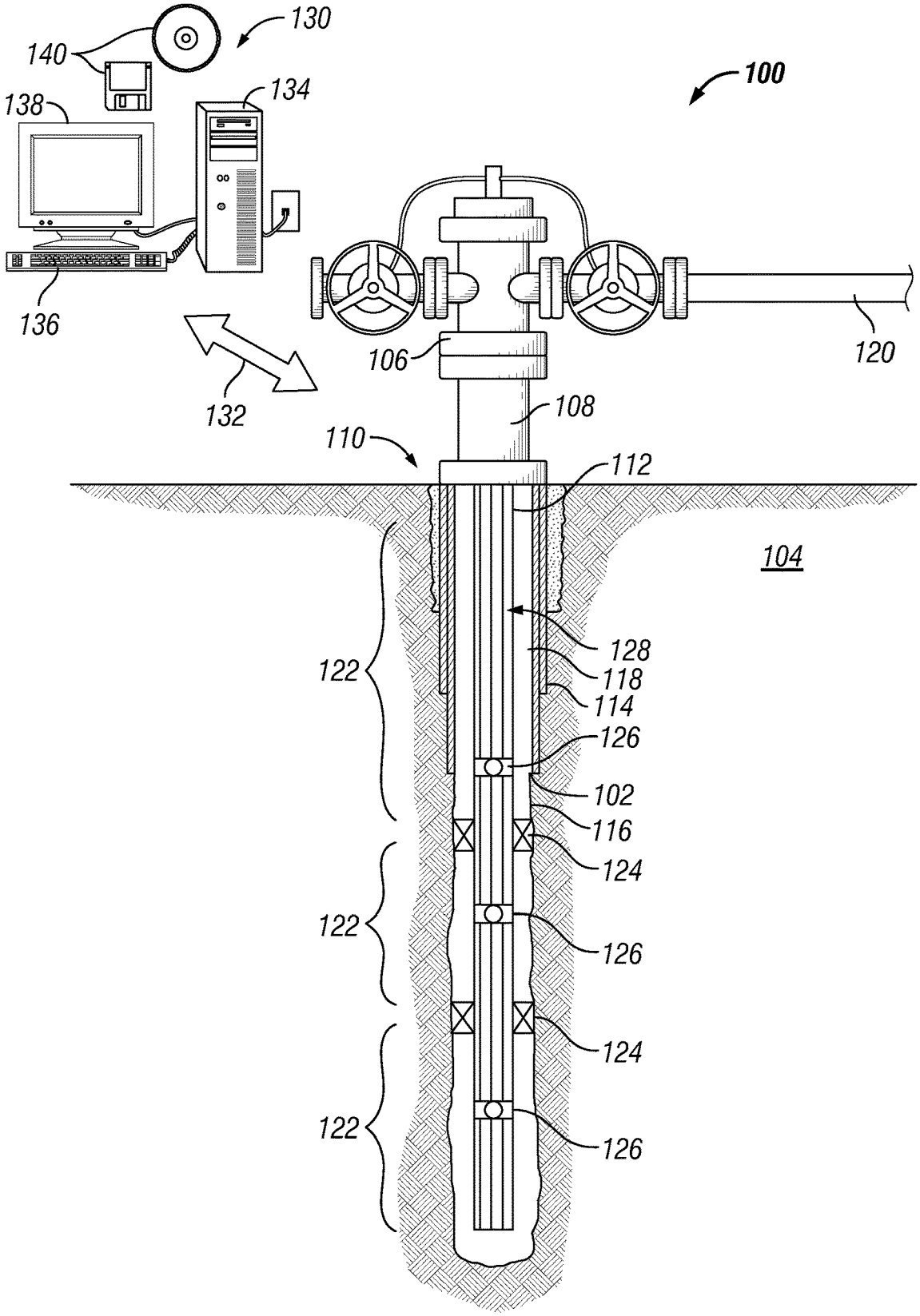
FIG. 1 illustrates an example of a production fluid recovery system disposed in a wellbore.

FIG. 1 illustrates a production fluid recovery system 100 disposed in a wellbore 102. While FIG. 1 illustrates production fluid recovery system 100, it should be noted that the systems, devices, and methods discussed in this application may also apply to injection wells. Production fluid recovery system 100 may comprise a wellbore 102 formed within a formation 104. Wellbore 102 may be a vertical wellbore as illustrated or it may be a horizontal and/or a directional well.

While production fluid recovery system 100 may be illustrated as land-based, it should be understood that the present techniques may also be applicable in offshore applications. Formation 104 may be made up of several geological layers and include one or more hydrocarbon reservoirs. As illustrated, production fluid recovery system 100 may include a production tree 106 and a wellhead 108 located at a well site 110. A production tubing 112 or a plurality of production tubing 112 may be coupled to production tree 106 and extend from wellhead 108 into wellbore 102, which may traverse formation 104.

In examples, wellbore 102 may be cased with one or more casing segments 114. Casing segments 114 help maintain the structure of wellbore 102 and prevent wellbore 102 from collapsing in on itself. In some examples, a portion of the well may not be cased and may be referred to as "open hole." The space between production tubing 112 and casing segments 114 or wellbore wall 116 may be an annulus 118. Production fluid may enter annulus 118 from formation 104 and then may enter production tubing 112 from annulus 118. Production tubing 112 may carry production fluid uphole to production tree 106. Production fluid may then be delivered to various surface facilities for processing via a surface pipeline 120.

In examples, wellbore 102 may be separated into a plurality of zones 122 with a plurality of packer 124 disposed in annulus 118. Packers 124 may separate wellbore 102 into isolated zones 122. Each portion of production tubing 112 disposed within one of the zones 122 may include a production tubing valve 126. When production tubing valve 126 is open, fluid may flow from a respective zone 122 into production tubing 112. When production tubing valve 126 is closed, fluid from the respective zone 122 is prevented from flowing into production tubing 112. Thus, the flow of fluid from each zone 122 into production tubing 112 may be controlled by controlling the opening and closing of the corresponding production tubing valve 126.

In examples, production tubing valves 126 may operate hydraulically and or electrically by a valve control system 128. Valve control system 128 may include a hydraulic system with hydraulic lines and/or an electrical system with electrical lines. Valve control system 128, and in turn the hydraulic system and electrical system, may be controlled by information handling system 130. Without limitation, information handling system 130 may communicate with valve control system 128 through communication line 132. Communication line 132 may be a wired communication and/or wireless communication.

Information handling system 130 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 130 may be a personal computer 134, a network storage device, or any other suitable device and may vary in size, shape, performance, functionality, and price. Information handling system 130 may include random access memory (RAM), one or more processing resources such as a central processing unit (CPU) or hardware or software control logic, ROM, and/or other types of nonvolatile memory. Additional components of information handling system 130 may include one or more disk drives, one or more network ports for communication with external devices as well as various input and output (I/O) devices, such as a keyboard 136, a mouse, and a video display 138. Information handling system 130 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, without limitation, storage media such as a direct access storage device 140 (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

As discussed below, production tubing valves 126 may be a solenoid operated valve (SOV). In examples, SOV's may be controlled through dedicated electrical wires from the surface, or through architecture, gauge power switching module, or through another, signaling mechanism. It should be understood that an SOV may be operate any downhole device, and the SOV is not limited to just production tubing valves 126. Production tubing valves 126 are merely representative of any number of downhole devices that an SOV may operate. Additionally, an SOV may be combined with other device to form a module, for example, as an intelligent completion tool.

Figure 2:
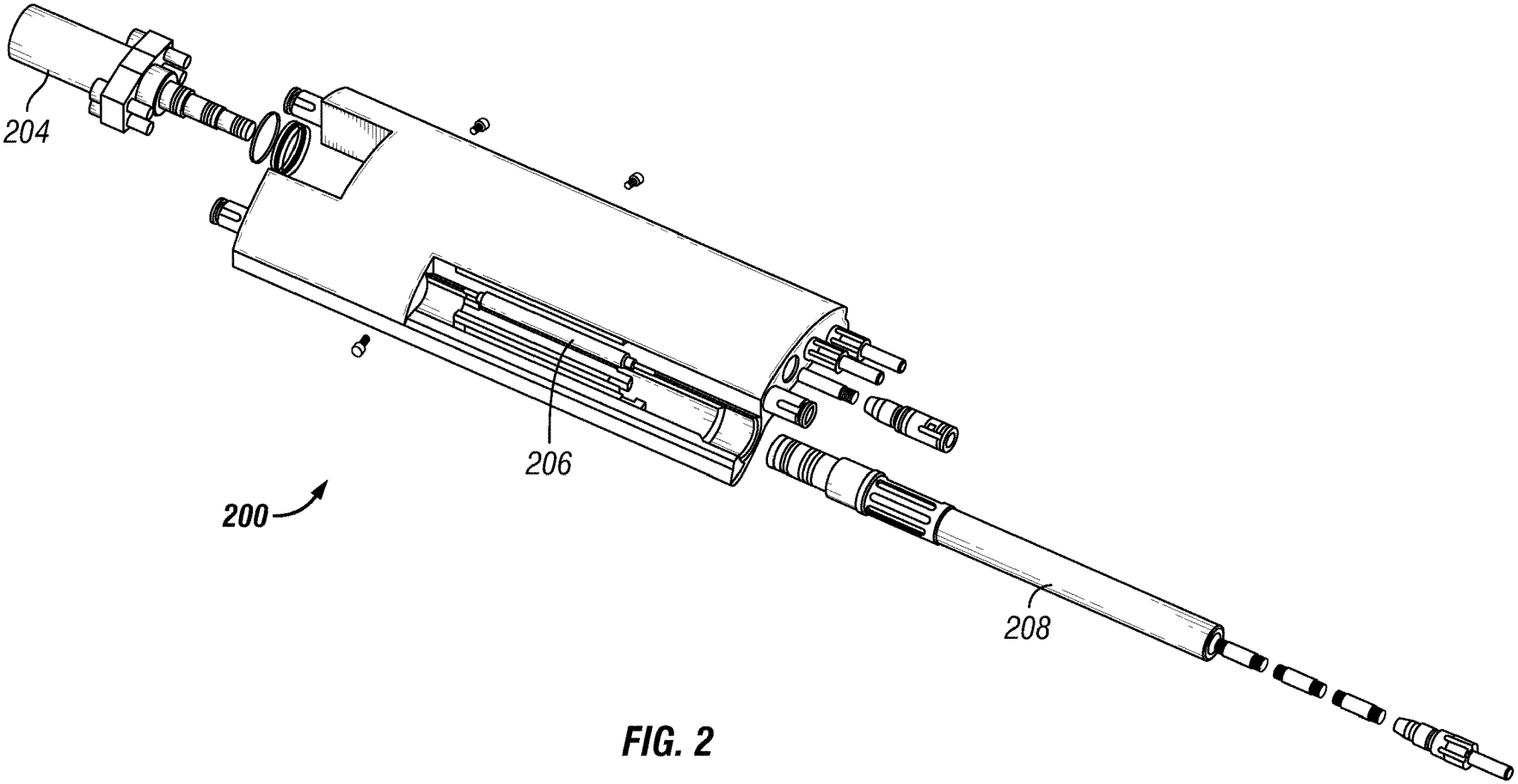
FIG. 2 illustrates an example of an actuation module.

FIG. 2 illustrates control housing 200, currently used, which may attach to and operate production tubing valves 126 (e.g., referring to FIG. 1). Control housing 200 may be used to actuate any downhole device. For example, downhole devices that may function by the actuation of an electric motor or a mechanical device (e.g., utilizing a solenoid). As illustrated in FIG. 2, control housing 200 may include a SOV 204, capsule 206, and hydraulic outputs 208.

Figure 6:
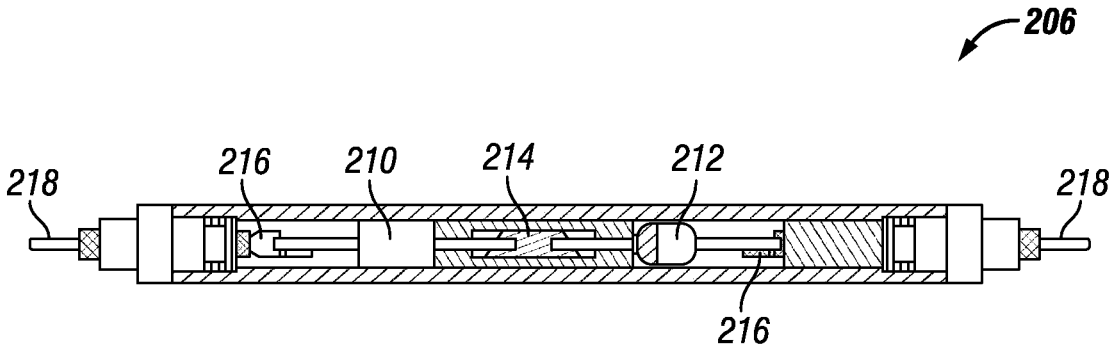
FIG. 6 illustrates a cross section of a capsule.

Referring to FIG. 6, capsule 206 houses a diode 212 and silicon bilateral voltage triggered switch thyristor (SIDAC) 210. Diode 212 is a semiconductor device with two terminals, typically allowing the flow of current in one direction only. SIDAC 210 an integrated circuit that is a breakover device that is designed to switch between voltages in both directions. As illustrated in FIG. 6, diode 212 and SIDAC 210 are electrically connected together by a conductive material 214. Connectors 216 may connect diode 212 and SIDAC 210 to individual terminals 218, as illustrated in FIG. 6. Connected in series, diode 212 and SIDAC 210 within capsule 206 may control the flow of electricity in specific directions. The flow of electricity may control hydraulic outputs 208.

Referring back to FIG. 2, while hydraulic outputs 208 are shown, any type of output may be used, such as mechanical outputs or electric outputs. In examples, SOV 204 may be a linear actuator, linear solenoid, or an electric motor. In examples, capsule 206 may be electrically connected to SOV 4 and hydraulic outputs 208. During operation capsule 206 may be used to control the flow of electricity to SOV 204, which may affect hydraulic outputs 208. Hydraulic outputs 208 may be any device that may utilize a constant power source to perform a function, for example, turn a motor or actuate a valve to communicate hydraulic pressure to move another valve, which may control well fluid or a chemical injection into a well.

Figure 3:
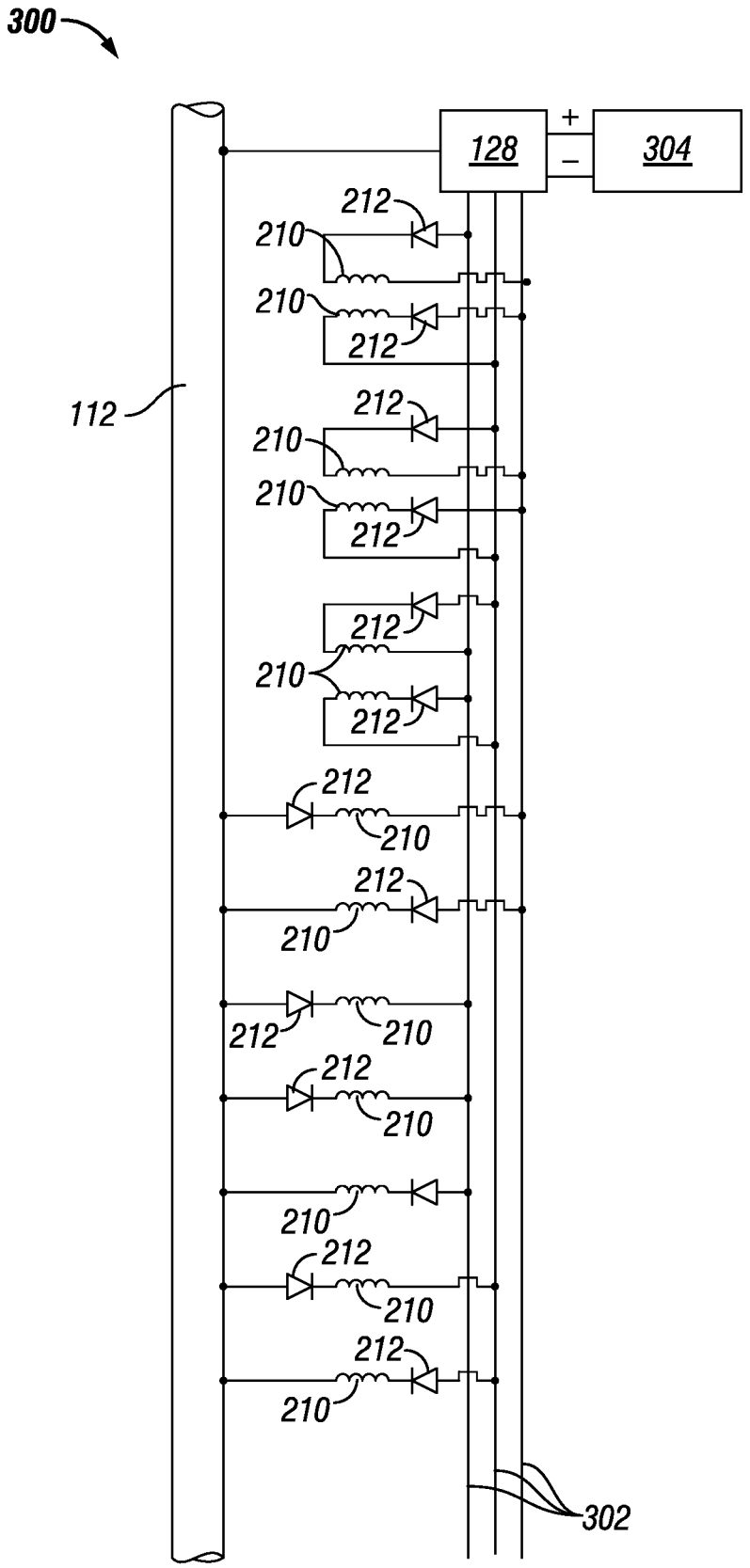
FIG. 3 is a schematic illustration of a plurality of actuation modules being used in conjunction with the production fluid recovery system.

FIG. 3 illustrates electrical schematic 300 for operating a plurality of production tubing valves 126 (e.g., referring to FIG. 1), with SIDAC 210 and diode 212 on production tubing 112. As illustrated, each SIDAC 210 and diode 212 represents a production tubing valve 126. During operations valve control system 128, which may be controlled by information handling system 130 (e.g., referring to FIG. 1), may select individual production tubing valves 126 by activating different electrical lines 302. Energizing individual electrical lines 302 may send a current to a selected control housing 200. The current may flow through SIDAC 210 and diode 212, as allowed by diode 212. Without limitation, valve control system 128 may be powered by power supply 304, which may be AC or DC power. Activating control housing 200 with valve control system 128 allows hydraulic communication to a zonal ICV (interval control valve) that is controlling well fluids from a zone (annulus) to the completion tubing string. In operations, there may be any number of control housings 200 for each ICV and each ICV may control a specific zone in a completed well. In examples, there may be any number of zones controlled by control housing 200, which may be controlled by any number of conductors. In examples, large wells may have up to 12 different zones with up to 4 different conductors. Going with separate hydraulic lines to each ICV for 12 zones may result in 13 separate control lines (12 open lines and 1 common close line) for each ICV. This may lead to a crowded wellbore 102 (e.g., referring to FIG. 1). To reduce crowding within the wellbore 102 and simplify operations, control housing 200 may be removed and replaced with a simpler device.

Figure 4:
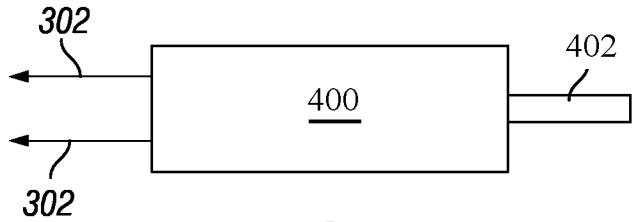
FIG. 4 is a schematic illustration of the actuation module.
Figure 5:
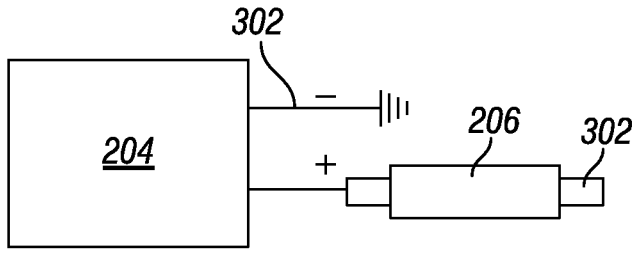
FIG. 5 is another schematic illustration of the actuation module.

FIG. 4 is a schematic view of actuation module 400. Actuation module 400 may replace control housing 200 in FIG. 3 for controlling production tube valve 126 (e.g., referring to FIG. 1). In examples, actuation module 400 includes both SOV 204, diode 212, and SIDAC 210 connected together within a housing. Additionally, SOV 204 may be connected to output 402. Output 402 may be a mechanical output, hydraulic output, which may operate another device such as an engine or a valve. Further illustrated in FIG. 4, actuation module 400 is connected to one or more electrical lines 302. When electrical lines 302 are activated, actuation module 400 may activate output 402. FIG. 5 is a schematic view of devices inside actuation module 400 (e.g., referring to FIG. 4). As illustrated, SOV 204 is electrically connected to SIDAC 210 and diode 212. Diode 212 may only allow for the flow of electrical current to go through SIDAC 210 to SOV 204. However, it should be noted that diode 212 may be reversed and may only allow electrical current to flow from SOV 204, through SIDAC 210, diode 212, and to the rest of the system.

Accordingly, the systems and methods disclosed herein may be directed to an actuation module. The systems and methods may include any of the various features of the systems and methods disclosed herein, including one or more of the following statements Statement 1. An actuation module may comprise a housing, a solenoid operated valve solenoid operated valve disposed in the housing, a diode disposed in the housing, a silicon bilateral voltage triggered switch thyristor disposed in the housing and electrically connected to the solenoid operated valve, and an output connected to the solenoid operated valve.

Statement 2. The actuation module of statement 1, wherein the output is controlled by the solenoid operated valve.

Statement 3. The actuation module of statement 2, wherein the output is a liner actuator.

Statement 4. The actuation module of statement 2, wherein the output is an electric motor.

Statement 5 The actuation module of statements 1 or 2, wherein the actuation module is connected to a production tubing valve.

Statement 6. The actuation module of statements 1, 2, or 5, wherein the output is connected to a production tubing valve.

Statement 7. The actuation module of statements 1, 2, 5, or 6, wherein the silicon bilateral voltage triggered switch thyristor allows electric current to only flow to the solenoid operated valve.

Statement 8. The actuation module of statements 1, 2, or 5-7, wherein the silicon bilateral voltage triggered switch thyristor allows electric current to only flow away from the solenoid operated valve.

Statement 9. A system may comprise a production tubing disposed in a wellbore, one or more production tubing valves connected to the production tubing, and an actuation module connected to each of the one or more production tubing valves.

Statement 10. The system of statement 9, wherein the actuation module may comprise a housing, a solenoid operated valve (solenoid operated valve) disposed in the housing, a diode, a silicon bilateral voltage triggered switch thyristor disposed in the housing and electrically connected to the solenoid operated valve, and an output connected to the solenoid operated valve.

Statement 11. The system of statement 10, wherein the silicon bilateral voltage triggered switch thyristor allows electric current to only flow to the solenoid operated valve.

Statement 12. The system of statement 10, wherein the silicon bilateral voltage triggered switch thyristor allows electric current to only flow away from the solenoid operated valve.

Statement 13. The system of statements 9 or 10, further comprising a valve control system connected to the actuation module by one or more electrical lines and the valve control system is configured to control the actuation module.

Statement 14. The system of statement 13, further comprising an information handling system connected to the valve control system and configured to control the valve control system.

Statement 15. The system of statements 9, 10, or 13, the output is a liner actuator or an electric motor.

Statement 16. A method may comprise connecting an actuation module to a production tubing valve, connecting the actuation module to a valve control system, connecting an information handling system to the valve control system, controlling the actuation module with the valve control system, and activating the production tubing valve with the actuation module.

Statement 17. The method of statement 16, wherein the actuation module may comprise a housing, a solenoid operated valve (solenoid operated valve) disposed in the housing, a diode, a silicon bilateral voltage triggered switch thyristor disposed in the housing and electrically connected to the solenoid operated valve, and an output connected to the solenoid operated valve.

Statement 18. The method of statement 17, wherein the silicon bilateral voltage triggered switch thyristor allows electric current to only flow to the solenoid operated valve.

Statement 19. The method of statements 17 or 18, wherein the silicon bilateral voltage triggered switch thyristor allows electric current to only flow away from the solenoid operated valve.

Statement 20. The method of statements 17-19, wherein the output is a liner actuator or an electric motor.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

All numerical values within the detailed description and the claims herein modified by "about" or "approximately" with respect the indicated value is intended to take into account experimental error and variations that would be expected by a person having ordinary skill in the art.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention.

What is claimed is:

1. An actuation module comprising:

a housing;

a solenoid operated valve (SOV) disposed in the housing;

a diode disposed in the housing;

a silicon bilateral voltage triggered switch thyristor (SIDAC) disposed in the housing and electrically connected to the solenoid operated valve;

an output connected to the solenoid operated valve; and a capsule configured to house the diode and the SIDAC, wherein the capsule comprises an intermediate chamber disposed between the SIDAC and the diode, wherein the intermediate chamber is configured to hold a conductive material, and wherein the SIDAC and the diode are electrically coupled via the conductive material.

2. The actuation module of claim 1, wherein the output is controlled by the solenoid operated valve.

3. The actuation module of claim 2, wherein the output is a linear actuator.

4. The actuation module of claim 2, wherein the output is an electric motor.

5. The actuation module of claim 1, wherein the actuation module is connected to a production tubing valve.

6. The actuation module of claim 1, wherein the output is connected to a production tubing valve.

7. The actuation module of claim 1, wherein the silicon bilateral voltage triggered switch thyristor allows electric current to only flow to the solenoid operated valve.

8. The actuation module of claim 1, wherein the silicon bilateral voltage triggered switch thyristor allows electric current to only flow away from the solenoid operated valve.

9. A system comprising:

a production tubing disposed in a wellbore;

one or more production tubing valves connected to the production tubing; and an actuation module connected to each of the one or more production tubing valves, wherein the actuation module comprises;

a housing;

a solenoid operated valve (SOV) disposed in the housing;

a diode disposed in the housing;

a silicon bilateral voltage triggered switch thyristor (SIDAC) disposed in the housing and electrically connected to the solenoid operated valve;

an output connected to the solenoid operated valve; and a capsule configured to house the diode and the SIDAC, wherein the capsule comprises an intermediate chamber disposed between the SIDAC and the diode, wherein the intermediate chamber is configured to hold a conductive material, and wherein the SIDAC and the diode are electrically coupled via the conductive material.

10. The system of claim 9, wherein the silicon bilateral voltage triggered switch thyristor allows electric current to only flow to the solenoid operated valve.

11. The system of claim 9, wherein the silicon bilateral voltage triggered switch thyristor allows electric current to only flow away from the solenoid operated valve.

12. The system of claim 9, further comprising a valve control system connected to the actuation module by one or more electrical lines and the valve control system is configured to control the actuation module.

13. The system of claim 12, further comprising an information handling system connected to the valve control system and configured to control the valve control system.

14. The system of claim 9, the output is a linear actuator or an electric motor.

15. A method comprising:

connecting an actuation module to a production tubing valve;

connecting the actuation module to a valve control system;

connecting an information handling system to the valve control system;

controlling the actuation module with the valve control system; and activating the production tubing valve with the actuation module, wherein the actuation module comprises;

a housing;

a solenoid operated valve (SOV) disposed in the housing;

a diode disposed in the housing;

a silicon bilateral voltage triggered switch thyristor (SIDAC) disposed in the housing and electrically connected to the solenoid operated valve;

an output connected to the solenoid operated valve; and a capsule configured to house the diode and the SIDAC, wherein the capsule comprises an intermediate chamber disposed between the SIDAC and the diode, wherein the intermediate chamber is configured to hold a conductive material, and wherein the SIDAC and the diode are electrically coupled via the conductive material.

16. The method of claim 15, wherein the silicon bilateral voltage triggered switch thyristor allows electric current to only flow to the solenoid operated valve.

17. The method of claim 15, wherein the silicon bilateral voltage triggered switch thyristor allows electric current to only flow away from the solenoid operated valve.

18. The method of claim 15, wherein the output is a linear actuator or an electric motor.

* * * * *